US005115714A

United States Patent [19]

Müller et al.

[11] Patent Number: 5,115,714

[45] Date of Patent: May 26, 1992

[54] APPARATUS FOR INFEEDING CARTRIDGES

[75] Inventors: Kurt Müller, Zurich; Erwin Bohler, Dubendorf; Bruno Ruppen, Zurich; Hanspeter Novet, Volketswil; Robert Gerber, Adlikon, all of Switzerland

[73] Assignee: Oerlikon-Contraves AG, Zurich, Switzerland

[21] Appl. No.: 671,111

[22] Filed: Mar. 18, 1991

[30] Foreign Application Priority Data

Apr. 2, 1990 [CH] Switzerland ..... 01095/90

[51] Int. Cl.[5] ..... F41A 9/30

[52] U.S. Cl. ..... 89/33.16; 89/33.17; 89/33.25; 89/33.04

[58] Field of Search ..... 89/33.04, 33.1, 33.14, 89/33.16, 33.17, 12, 13.05, 33.5, 33.25, 34

[56] References Cited

U.S. PATENT DOCUMENTS

| | | | |
|---|---|---|---|
| 3,041,939 | 7/1962 | Dardick . | |
| 3,995,527 | 12/1976 | Schiele et al. | 89/33.04 |
| 4,359,927 | 11/1982 | Tassie | 89/12 |
| 4,434,699 | 3/1984 | Tassie | 89/12 |
| 4,434,701 | 3/1984 | Voillot | 89/34 |
| 4,492,144 | 1/1985 | Dix | 89/33.17 |
| 4,557,528 | 12/1985 | Leiber | 303/92 |
| 4,612,843 | 9/1986 | Marcon et al. | 89/33.04 |
| 4,656,922 | 4/1987 | Bohler et al. | 89/33.17 |
| 4,674,392 | 6/1987 | Beckmann | 89/33.04 |
| 4,681,018 | 7/1987 | Beckmann | 89/33.04 |
| 4,765,223 | 8/1988 | Beckman | 89/33.04 |
| 4,836,082 | 6/1989 | Dardick | 89/12 |

FOREIGN PATENT DOCUMENTS

| | | | |
|---|---|---|---|
| 0020095 | 12/1980 | European Pat. Off. . | |
| 152549 | 8/1985 | European Pat. Off. | 89/33.16 |
| 0184008 | 6/1986 | European Pat. Off. . | |
| 3342223 | 5/1984 | Fed. Rep. of Germany | 89/33.04 |
| 2468869 | 5/1981 | France . | |
| 669450 | 3/1989 | Switzerland | 89/33.16 |
| 2092281 | 8/1982 | United Kingdom | 89/12 |

*Primary Examiner*—Stephen Johnson

*Attorney, Agent, or Firm*—Sandler, Greenblum & Bernstein

[57] ABSTRACT

When using a multi-barrel firing weapon, such as a Gatling-type gun or canon, it is desired during a firing burst, to first fire the initial or lead cartridge or ammunition round when the rotating array of weapon barrels, during running up to speed, has attained its full rotational speed, that is, when the firing weapon is capable of firing at the full or maximum firing rate. In this way there is realized the desired high precision and low round scattering of the weapon system. The cartridge infeed apparatus requires a certain amount of time until it has reached its full cartridge infeed velocity. The initial or lead cartridge therefore should only then be delivered to the multi-barrel firing weapon after completion of the running up to speed of the array of weapon barrels and after the cartridge infeed apparatus has reached its full or maximum cartridge infeed velocity. To that end, there are provided two cartridge transfer wheels which are interconnected by a clutch, these cartridge transfer wheels being arranged between two endless chains. There are also provided a separate cartridge return channel and a sensor for determining the starting position of the initial or lead cartridge.

2 Claims, 10 Drawing Sheets

APPARATUS FOR INFEEDING CARTRIDGES

BACKGROUND OF THE INVENTION

1. Field of the Invention

The present invention relates to a new and improved apparatus for controllably infeeding cartridges from a stationary magazine or supply container to a firing weapon, especially to a multi-barrel gun or cannon.

In its more specific aspects, the cartridge infeed apparatus for a firing weapon, especially a multi-barrel gun or cannon having a rotating array or cluster of weapon barrels, is of the type comprising gate or switch means for switching-on and switching-off the infeed of the cartridges, a first endless chain for the delivery of the cartridges from the gate or switch means to the firing weapon, and a second endless chain with controllable return for the delivery of the cartridges from the stationary magazine to the gate or switch means.

The cartridge infeed apparatus of the present development is particularly suitable for use in conjunction with firing weapons having an external drive, for instance, Gatling-type guns or the like. As is well known in the weapons art, a Gatling-type gun or cannon possesses a cluster or array of weapon barrels. In this type of weapon system the run-up of the firing weapon until reaching its full or maximum firing rate or cadence leads to pronounced round scattering, and thus, the first round to be fired should only then be fired after the cluster or array of weapon barrels has attained its set or reference rotational speed, in other words, during the time that the firing weapon runs up to speed ammunition rounds should not be fired. Furthermore, the cartridge infeed apparatus itself requires a certain amount of time until it has attained the full or maximum cartridge infeed velocity. Moreover, this cartridge infeed apparatus should possess the capability of infeeding two different types of ammunition.

2. Discussion of the Background and Material Information

European Patent Application No. 0, 020,095, published Dec. 10, 1980 teaches a prior art construction of cartridge infeed apparatus of the aforementioned general type, wherein there is provided a storage or accumulator. A transport chain is guided through an infeed channel, a supply or storage channel and through a return channel. The infeed channel opens into a transfer station of the firing weapon. At the transfer location between the infeed channel and the storage or supply channel there is arranged a gate or switch. In one position of the gate, ammunition moves from the infeed channel to a further infeed system having a second transport chain leading to the transfer station of the firing weapon. In the other position of this gate, ammunition at the transport chain moves through the supply or storage channel into the return channel. By means of a switch or trigger mechanism which is connected with the firing weapon, it is possible to switch or shift the gate from its first position into its second position. The infeed system continues to further forwardly rotate until all cartridges have been removed therefrom. The first transport chain moves further forwards and places the ammunition into the supply channel. A reversing device or mechanism subsequently rearwardly moves or reverses the first transport chain until the ammunition in the supply channel again is positioned in the infeed channel. Thereafter the ammunition is directly infed to the firing weapon for the next firing burst. This prior art apparatus is intended to preclude residence of individual cartridges in the firing chambers of the firing weapon after accomplishing a firing burst or series firing operation, which otherwise could lead to malfunction of the firing weapon. However, this apparatus is incapable of first delivering the initial or lead cartridge to the firing weapon after the firing weapon has run up to speed.

From U.S. Pat. No. 4,836,082, granted Jun. 6, 1989, it is known that in a multi-barrel gun or cannon, a so-called cloud gun, the infeed of cartridges is not activated during the run up to speed of the firing weapon. Only after a subsequent desired firing command has been given, are there activated the drives for the cartridge infeed devices. What is here considered disadvantageous is the need to maintain the multi-barrel gun in rotation for the attainment of the firing readiness of the firing weapon and there is not taken into account the time required for the cartridge infeed system to run up to speed.

SUMMARY OF THE INVENTION

Therefore, with the foregoing in mind, it is a primary object of the present invention to provide an improved apparatus for infeeding cartridges to a firing weapon, especially to a multi-barrel gun or cannon, which is not afflicted with the aforementioned limitations and drawbacks of the prior art.

Another and more specific object of the present invention aims at the provision of an improved apparatus for the infeed of cartridges to a firing weapon which first feeds cartridges to the firing weapon after the firing weapon has run up to speed and there has been simultaneously reached the full cartridge infeed velocity, and after each series firing or firing burst there can be rapidly and reliably established the initial conditions.

Still a further noteworthy object of the present invention is the provision of a new and improved ammunition infeed apparatus which takes into account both the run up to speed of the firing weapon and also the time needed for the running up to speed of the ammunition infeed apparatus.

Now in order to implement these and still further objects of the present invention, which will become more readily apparent as the description proceeds, the cartridge infeed apparatus of the present development is manifested, among other things, by the features that two transfer wheels are arranged between the first endless chain and the second endless chain. A clutch operatively interconnects the two transfer wheels with one another. A sensor serves to determine the starting position of the first or lead cartridge, which is to be delivered to the firing weapon, at the second endless chain. A separate channel serves for the return of the spent cartridge casings from the first endless chain, and the gate means is switched and thereafter the clutch is deactivated for the termination of a firing burst or series firing.

One of the more notable advantages of the present invention resides in the fact that there is not only taken into account the run up to speed of the firing weapon but also the time needed for the cartridge infeed apparatus to run up to speed and such conditions can be exactly accommodated to one another.

Also, preferably two different types of ammunition can be infed, in order to selectively use cartridges from the one stationary ammunition magazine or a second stationary ammunition magazine.

BRIEF DESCRIPTION OF THE DRAWINGS

The invention will be better understood and objects other than those set forth above, will become apparent when consideration is given to the following detailed description thereof. Such description makes reference to the annexed drawings depicting an ammunition or cartridge infeed apparatus constructed according to the invention, wherein.

DETAILED DESCRIPTION OF THE PREFERRED EMBODIMENTS

Figure 1:
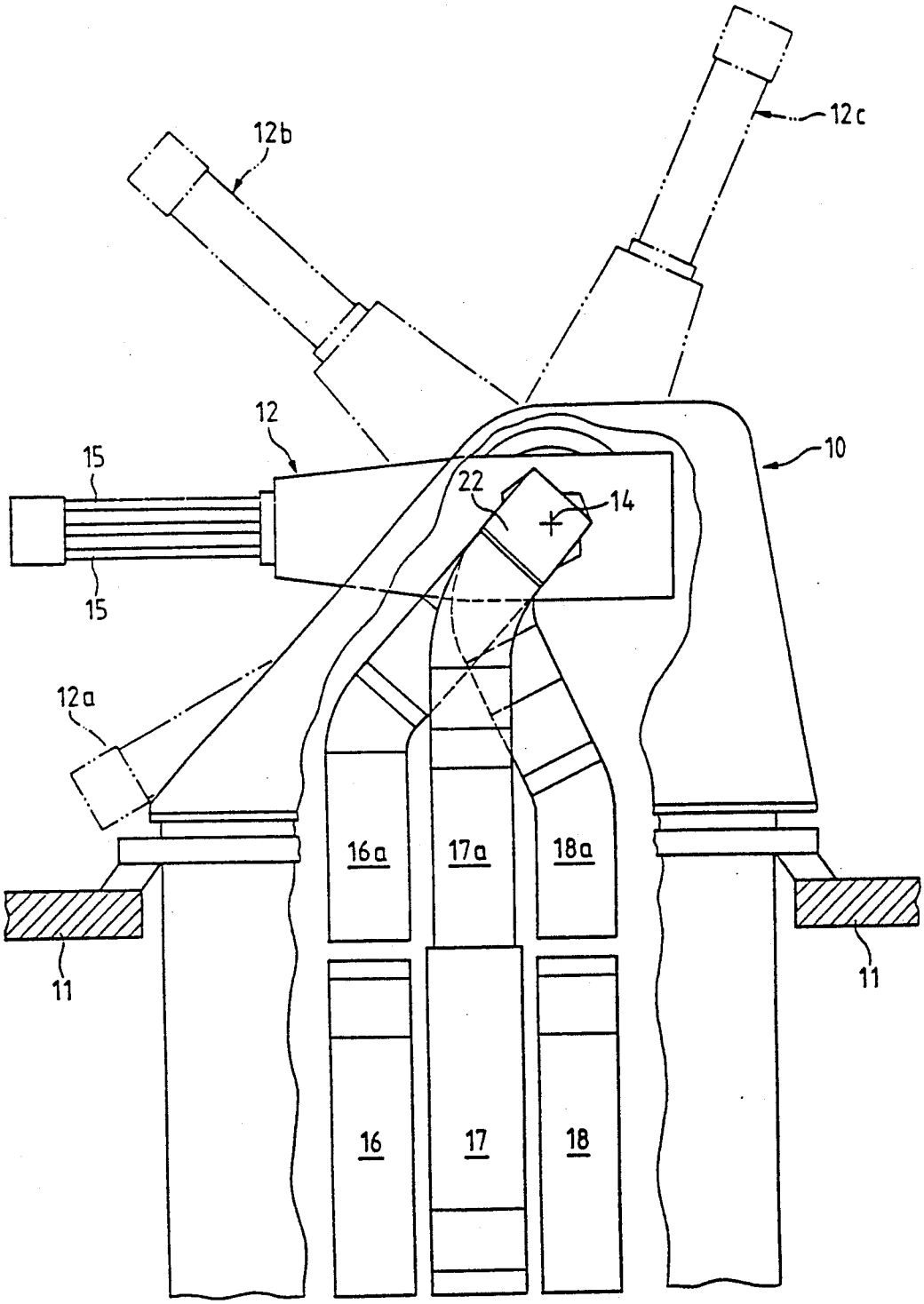
FIG. 1 schematically illustrates in side view a gun mounting structure, here shown, for instance, as an armored turret equipped with two multi-barrel firing weapons, so-called Gatling-type guns or cannons.

Describing now the drawings, it is to be understood that only enough of the construction of the cartridge or ammunition infeed apparatus and the related multi-barrel firing weapons has been depicted therein, in order to simplify the illustration, as needed for those skilled in the art to readily understand the underlying principles and concepts of the present invention. Turning attention now to FIG. 1 of the drawings, there is depicted an armored turret 10 or equivalent structure which is appropriately rotatably mounted upon the deck of a vessel or upon a vehicle platform 11. According to the showing of FIGS. 1 and 2 there are pivotably mounted two multi-barrel firing weapons 12 and 13, so-called Gatling-type guns or cannons, at the armored turret 10 for rotation about an elevation axis 14. As best seen by further referring to FIG. 1, the two multi-barrel firing weapons 12 and 13 can be elevated out of their horizontal disposition, shown in full lines, into different positions; for example, they can be elevationally lowered through an angle of about 30° into the position 12*a*, or elevated through an angle of about 42.5° into the position 12*b*, or elevated through an angle of about 115° into the position 12*c*. As clearly depicted in FIG. 2, each of the two multi-barrel firing weapons 12 and 13 contains an array of seven weapon barrels 15

Figure 3:
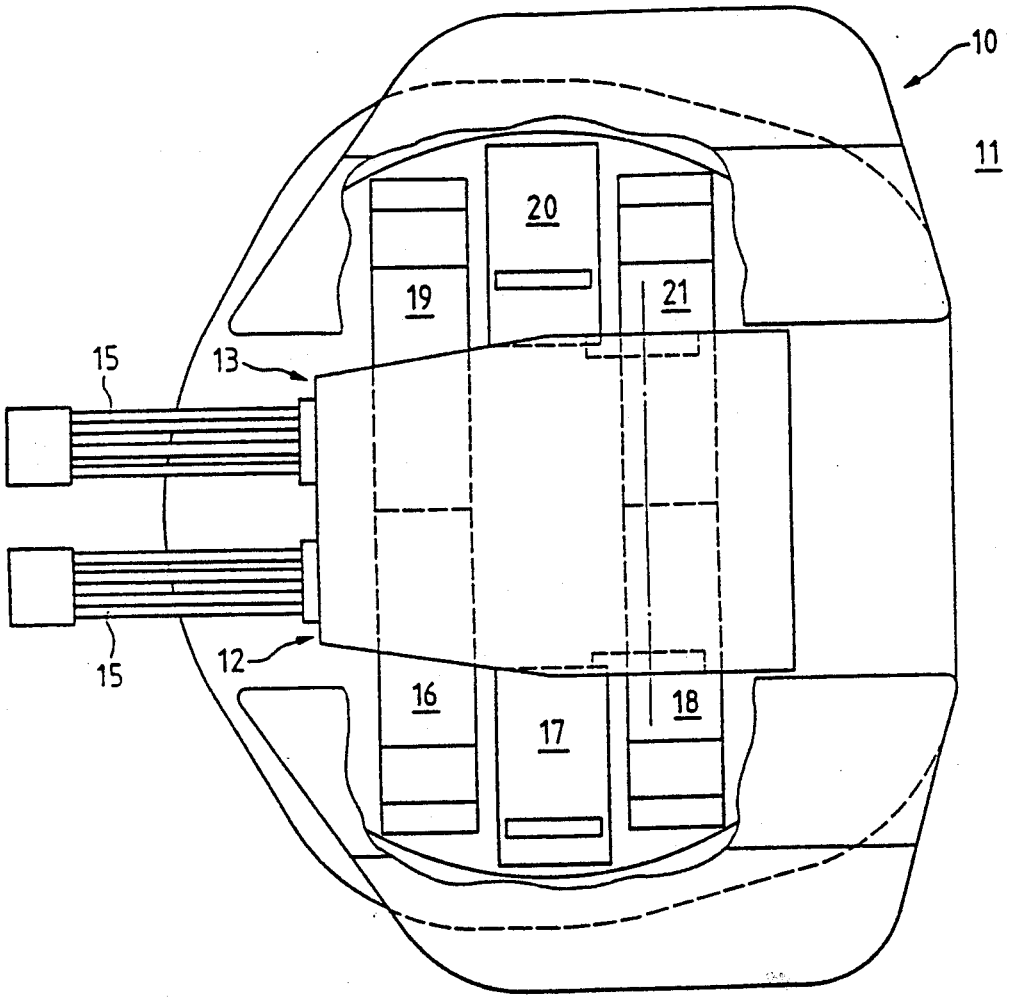
FIG. 3 schematically illustrates in top plan view the armored turret of FIG. 1.

Each multi-barrel firing weapon 12 and 13 has located therebelow three ammunition or cartridge magazines 16, 17, 18 and 19, 20, 21, respectively, as particularly well shown in FIG. 3. The ammunition or cartridge magazines 16 and 19 which are located most forwardly, as viewed in the weapon firing direction, contain a first type of ammunition and the ammunition or cartridge magazines 18 and 21 which are located rearmost, again as viewed in the weapon firing direction, contain a second type of ammunition. Both of the intermediately disposed ammunition or cartridge magazines 17 and 20 serve for reception of the empty or spent cartridge casings.

Figure 5:
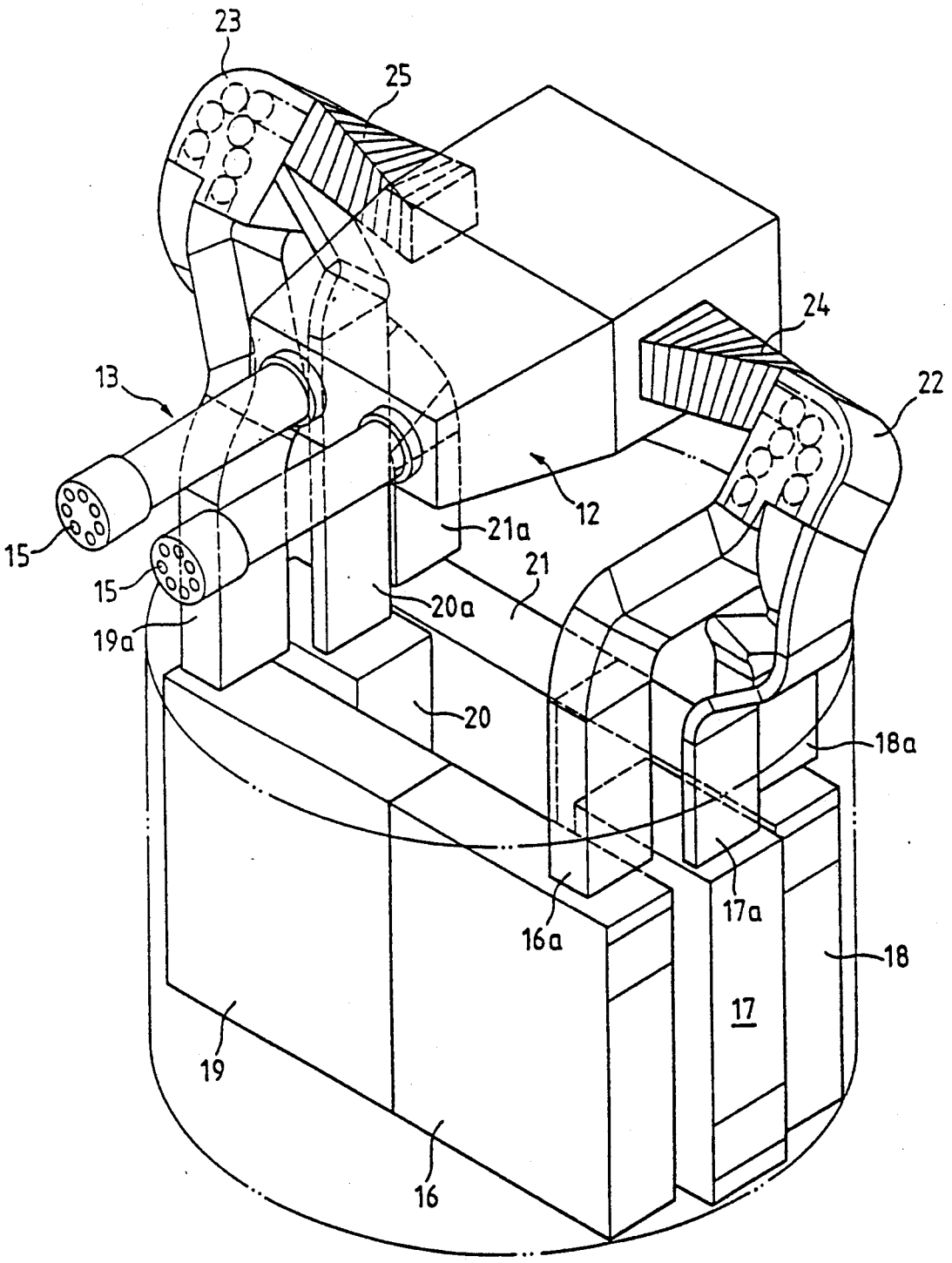
FIG. 5 schematically illustrates in perspective view the armored turret of FIGS. 1 to 3.

A respective supply channel 16*a*, 17*a*, 18*a*, 19*a*, 20*a* and 21*a* extends from each ammunition magazine or container 16, 17, 18, 19, 20 and 21, respectively, to one of the two multi-barrel firing weapons 12 and 13, respectively. FIG. 5 clearly depicts these six channels 16*a*, 17*a*, 18*a*, 19*a*, 20*a* and 21*a*. Within the channels 16*a* and 19*a* one type of ammunition or cartridges are delivered to the respective multi-barrel firing weapons 12 and 13, and in the channels 18*a* and 21*a* there are delivered the other type of ammunition or cartridges to the multi-barrel firing weapons 12 and 13, respectively. The empty or spent cartridge casings of both ammunition types move through the return channels 17*a* and 21*a* for deposit into the intermediate ammunition magazines 17 and 20, respectively. Each of three respective channels 16*a*, 17*a*, 18*a* and 19*a*, 20*a*, 21*a* lead into a respective common housing 22 and 23. A first elastic or flexible channel 24 extends from the first housing 22 to the first multi-barrel firing weapon 12 and a second elastic or flexible channel 25 extends from the second housing 23 to the second multi-barrel firing weapon 13.

Figure 2:
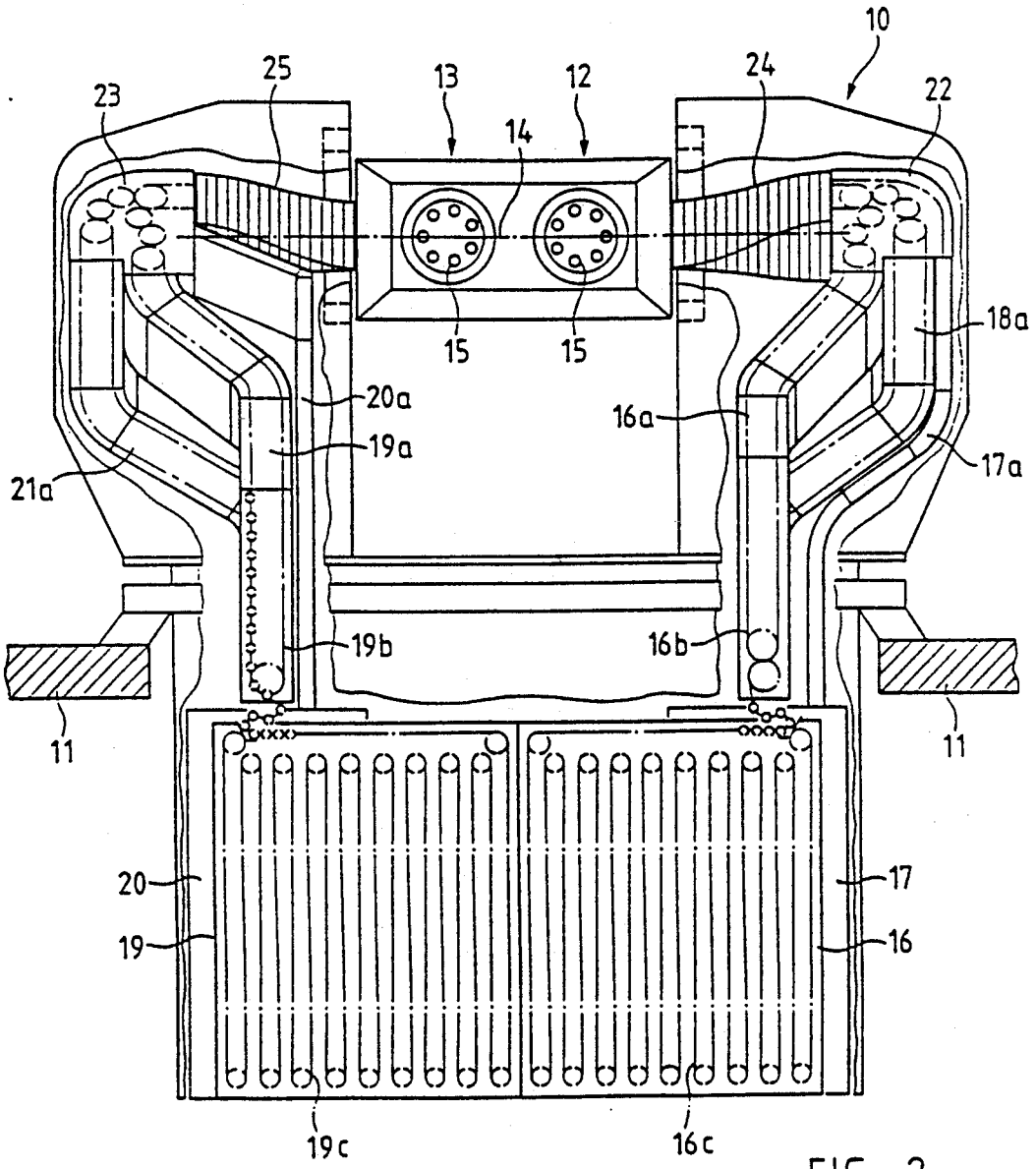
FIG. 2 schematically illustrates in front view the armored turret of FIG. 1.
Figure 4:
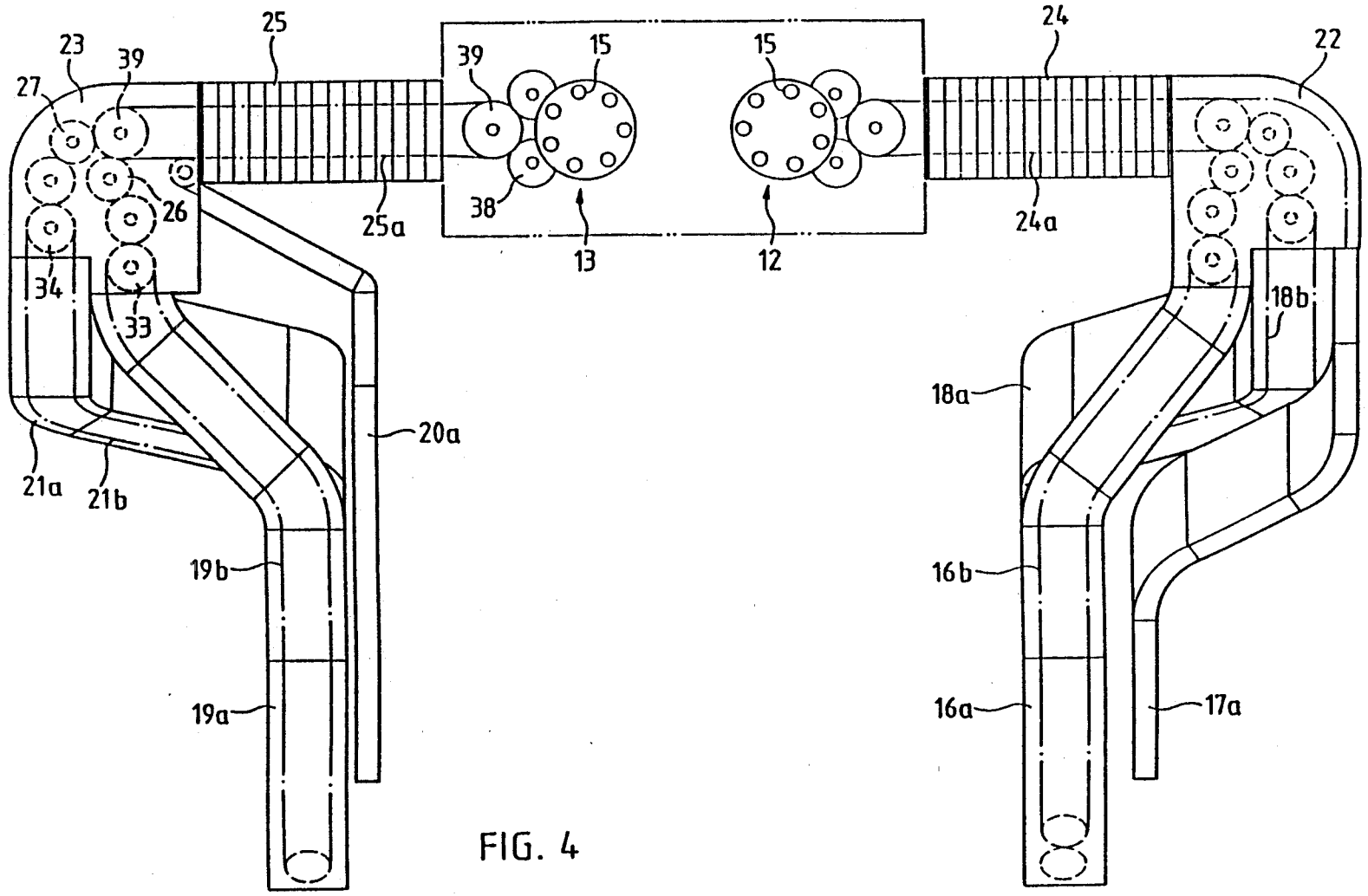
FIG. 4 schematically illustrates in front view the cartridge infeed apparatus of the arrangement of FIGS. 1 to 3.

Referring to FIG. 2, endless chains 16*b* and 19*b* or equivalent feed structure are located in the channels 16*a* and 19*a*, respectively, by means of which the cartridges 32 from the respective ammunition magazines 16 and 19 can be transported to the housings 22 and 23, respectively. According to the showing of FIG. 4, endless chains 24*a* and 25*a* or the like are likewise arranged in the elastic or flexible channels 24 and 25, respectively, and by means of these endless chains 24*a* and 25*a* the cartridges 32 can be delivered from the housings 22 and 23, respectively, to the multi-barrel firing weapons 12 and 13, respectively. Endless chains 16*c* and 19*c* or equivalent structure are likewise located in the respective ammunition magazines 16 and 19, in which endless chains 16*c* and 19*c* the cartridges 32 are first of all stored, and secondly, transported to the endless chains 16*b* and 19*b*. Comparable endless chains, which have not been shown to simplify the illustration, are equally located in the ammunition magazines 18 and 21. In FIG. 4 there are shown the further endless chains 18*b* and 21*b* which are located in the respective channels 18*a* and 21*a*.

Figure 6:
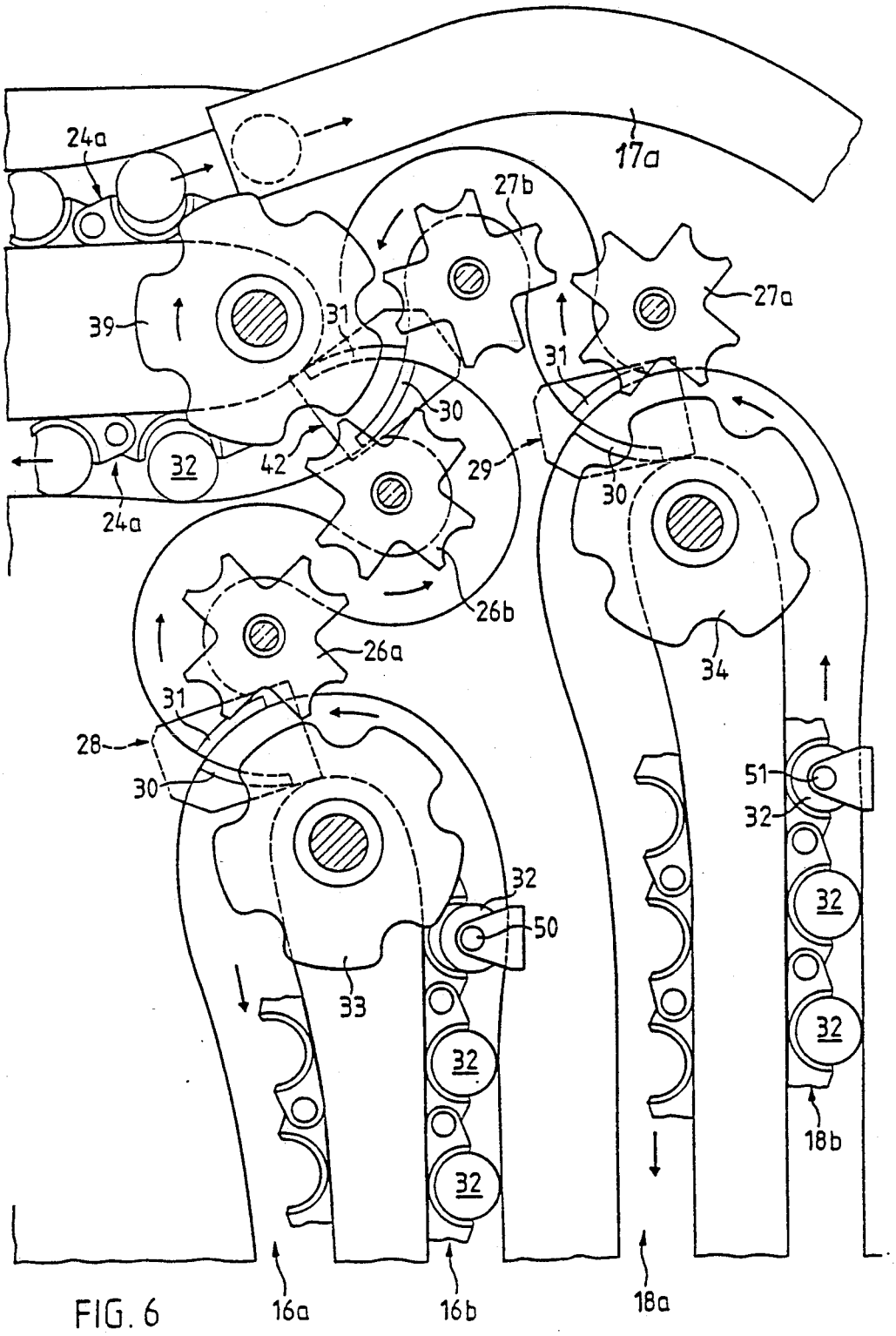
FIGS. 6, 6*a* and 6*b* schematically illustrate, in respective enlarged views, details of the cartridge infeed apparatus.

FIG. 6 depicts the transfer of the cartridges 32 from the endless chains 16*b* or 18*b* to the common endless chain 24*a*. Two transfer wheels or sprockets 26*a* and 26*b* or equivalent structure are arranged between the endless chain 16*b* and the endless chain 24*a*. Moreover, two further transfer wheels or sprockets 27*a* and 27*b* or equivalent structure are arranged between the endless chain 18*b* and the endless chain 24*a*. A first gate or switch 28 renders possible the transfer of the cartridges 32 from the endless chain 16*b* to the first transfer wheel 26*a* when this gate or switch 28 is in a first operating position. In the other operating position of this gate or switch 28 the cartridges 32 remain upon the endless chain 16*b* and are returned back to the ammunition magazine 16. A second gate or switch 29 allows transfer of the cartridges 32 from the endless chain 18*b* to the third transfer wheel 27*a* whenever this second gate or switch 29 is located in its first operating position. In the other operating position of the gate or switch 29 the cartridges 32 remain upon the endless chain 18*b* and are moved back to the ammunition magazine 18.

The construction of these gates or switches 28 and 29 is known to the art and there can be advantageously used gate constructions as disclosed, for instance, in European Patent No.0,184,008, published Jun. 11, 1986, to which reference may be readily had and the disclosure of which is incorporated herein in its entirety by reference. These gates 28 and 29 each contain two deflection segments or elements 30 and 31, and at any given time the one or the other deflection segment 30 or 31 is effective or operable. Assuming that the deflection segment 30 of the gate 28 is operable, then the cartridges 32 arrive from the endless chain 16*b* at the transfer wheel 26*a*. In the event that the other deflection segment 31 of the gate 28 is operable, then the cartridges 32 remain upon the endless chain 16*b*. The same is analogously true for the two deflection segments 30 and 31 of the second gate 29.

A third gate or switch 42 is arranged between the two transfer wheels 26*b* and 27*b* and the first endless chain 24*a*. In the position of this gate 42 depicted in FIG. 6 the deflection segment 31 is operative and the cartridges 32 arrive from the deflection wheel 26*b* at the endless chain 24*a*. Upon switching or throwing the gate 42 the other deflection segment 30 is now operative and the cartridges 32 arrive from the deflection wheel 27*b* at the endless chain 24*a*. Each of the four channels 16*a*, 18*a*, 19*a* and 21*a* have associated therewith a respective sensor 50 or 51, the position of which is determinative of the starting position of the first or initial or lead cartridge 32 which is to be delivered to the associated firing weapon 12 and 13.

At this point to facilitate the description of the invention there will be considered in greater detail the structure for feeding the ammunition or cartridges of one or the other type to one of the multi-barrel firing weapons, here the multi-barrel firing weapon 12. It is to be specifically understood, however, that comparable structure is provided for the other multi-barrel firing weapon 13, so that the hereinafter given detailed description concerning the construction and operation of the multi-barrel firing weapon 12 is equally applicable to the other multi-barrel firing weapon 13.

Continuing, it will be observed that both the endless chain 16*b* and also the endless chain 18*b* are trained about a respective deflection wheel or sprocket 33 and 34 or equivalent chain deflection or turning structure. As will be understood from FIG. 6*a*, the deflection wheel 33 of the endless chain 16*b* is in drive connection with the transfer wheel 26*a* by means of two gears 43 and 44. Furthermore, the deflection wheel 34 of the endless chain 18*b* is in drive connection with the transfer wheel 27*a* by means of two gears 45 and 46. The endless chain 24*a* is trained about a deflection wheel or sprocket 39. This deflection wheel 39 of the endless chain 24*a* is in drive connection with the transfer wheel 26*b* by means of two gears 49 and 47. Moreover, this deflection wheel 39 of the endless chain 24*a* is in drive connection with the transfer wheel 27*b* by means of the gear 49 and the further gear 48.

Figure 6A:
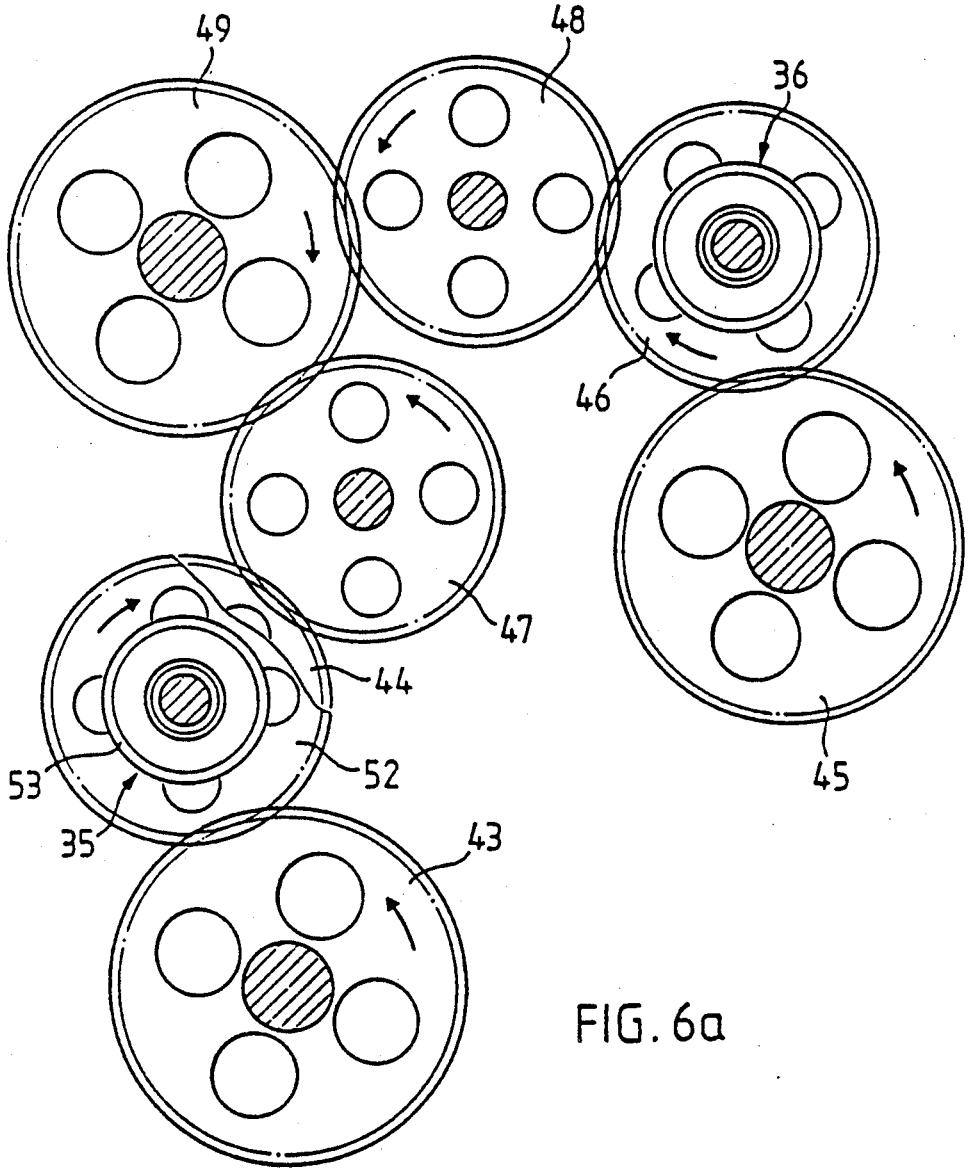
Figure 6B:
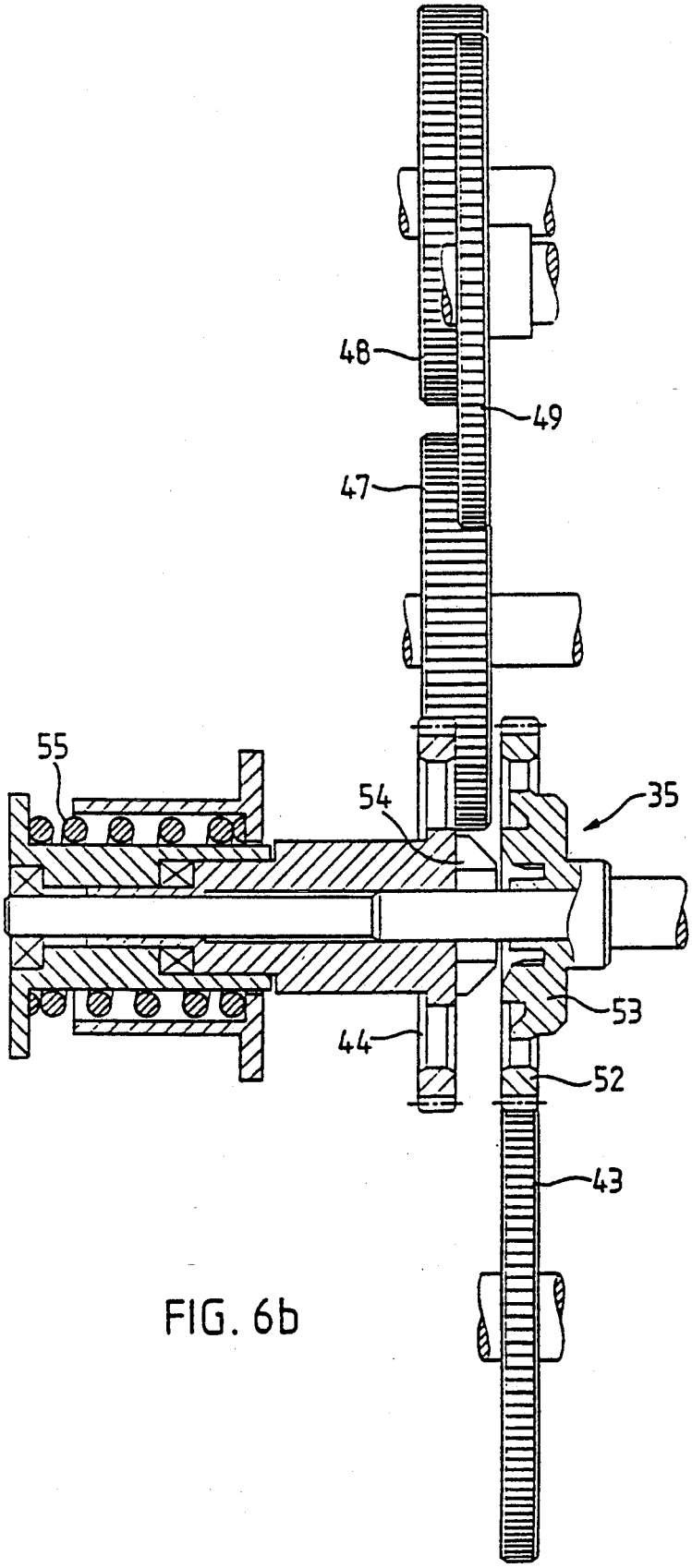
Figure 8:
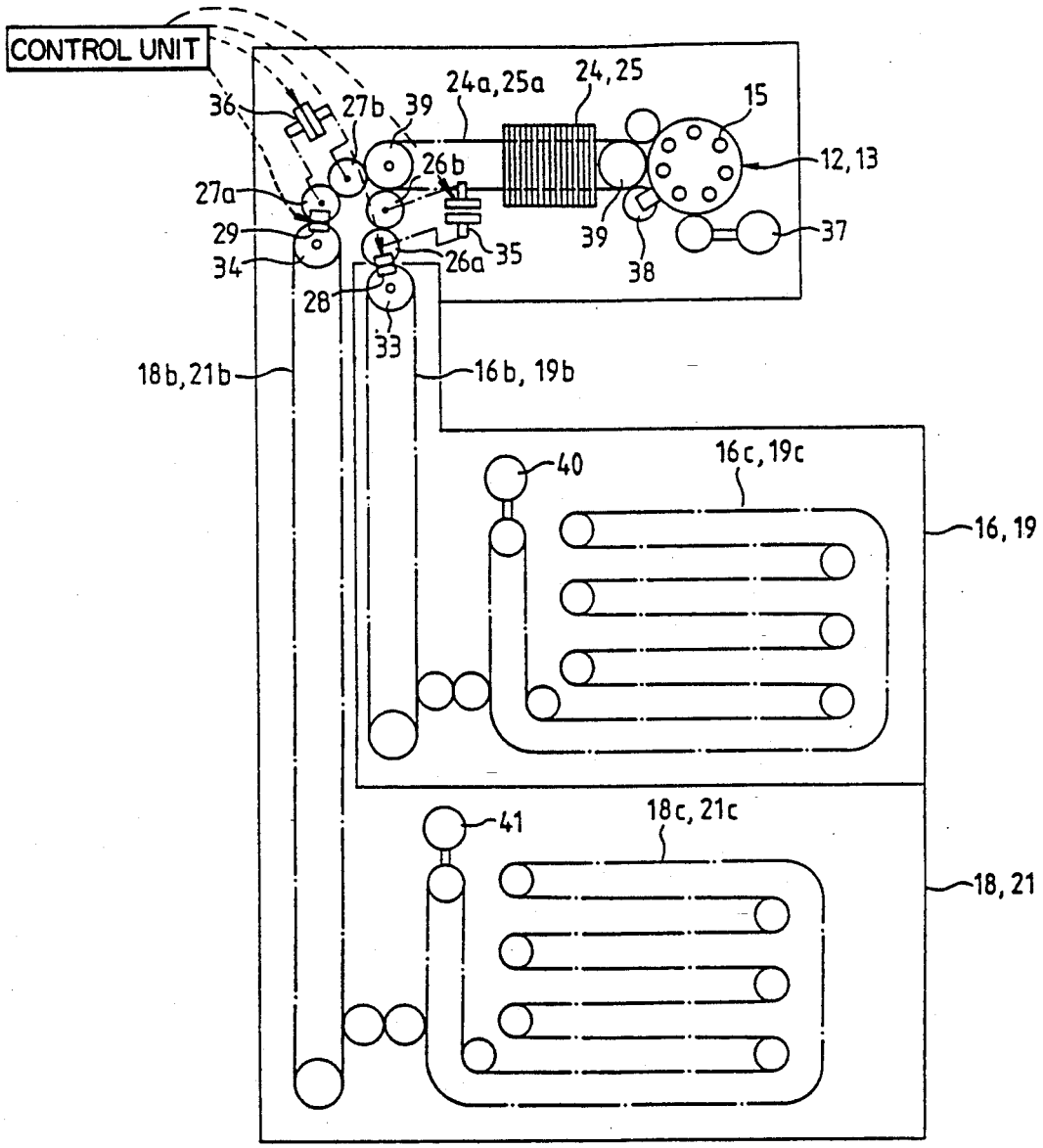
FIG. 8 is a schematic detail view of the entire firing weapon system.

As will be understood by inspecting FIGS. 6*a*, 6*b* and 8, the gears 43 and 44 can be brought into meshing relationship by means of a clutch 35 or the like, and equally, the gears 45 and 46 can be brought into meshing relationship by means of a clutch 36 or the like. If the clutch 35 is engaged, then cartridges 32 can be transferred from the endless chain 16*b* and the transfer wheels 26*a* and 26*b* to the endless chain 24*a*. On the other hand, if the other clutch 36 is engaged, then cartridges 32 can be transferred from the other endless chain 18*b* to the endless chain 24*a* by means of the transfer wheels 27*a* and 27*b*. Therefore, it will be apparent that cartridges 32 either are delivered from the ammunition magazine 16 to the multi-barrel firing weapon 12, or, when the other clutch 36 is engaged or activated, then cartridges 32 are delivered from the other ammunition magazine 18 to the multi-barrel firing weapon 12. Thus, these clutches 35 and 36 render possible the selective switching from one type of ammunition to another type of ammunition, and hence, constitute switching means for the selective infed of cartridges from one or the other ammunition magazine 16 or 18 or 19 or 21 to the respective multi-barrel firing weapons 12 and 13. On the other hand, the gates 28 and 29 allow the determination from which ammunition magazine the first cartridge 32 should be delivered to the multi-barrel firing weapon 12 and that point in time when there should be interrupted the delivery of cartridges 32 to the multi-barrel firing weapon 12. For the reasons previously stated, comparable observations are valid as concerns the cartridge infeed apparatus associated with the other multi-barrel firing weapon 13.

According to the showing of FIG. 6*b*, a second gear 52, of exactly the same size as the gear 44, is located behind this gear 44. The gear 44 is continuously in mesh with the next gear 47 and the other gear 52 is continuously in mesh with the neighboring gear 43. Both of the gears 44 and 52 which are arranged in tandem upon the same shaft, can be brought into mesh with one another by the aforementioned clutch 35. This clutch 35 is composed of two clutch halves or portions 53 and 54 which can be brought into engagement with one another by axially displacing the same hydraulically for instance, and a suitable resilient element, such as a spring 55 exerts the requisite force for disengaging the interengaged clutch halves or portions 53 and 54. As to the other clutch 36 shown in FIG. 8, such is of the exact same construction as the just described clutch 35 and therefore need not be here further considered.

Figure 7:
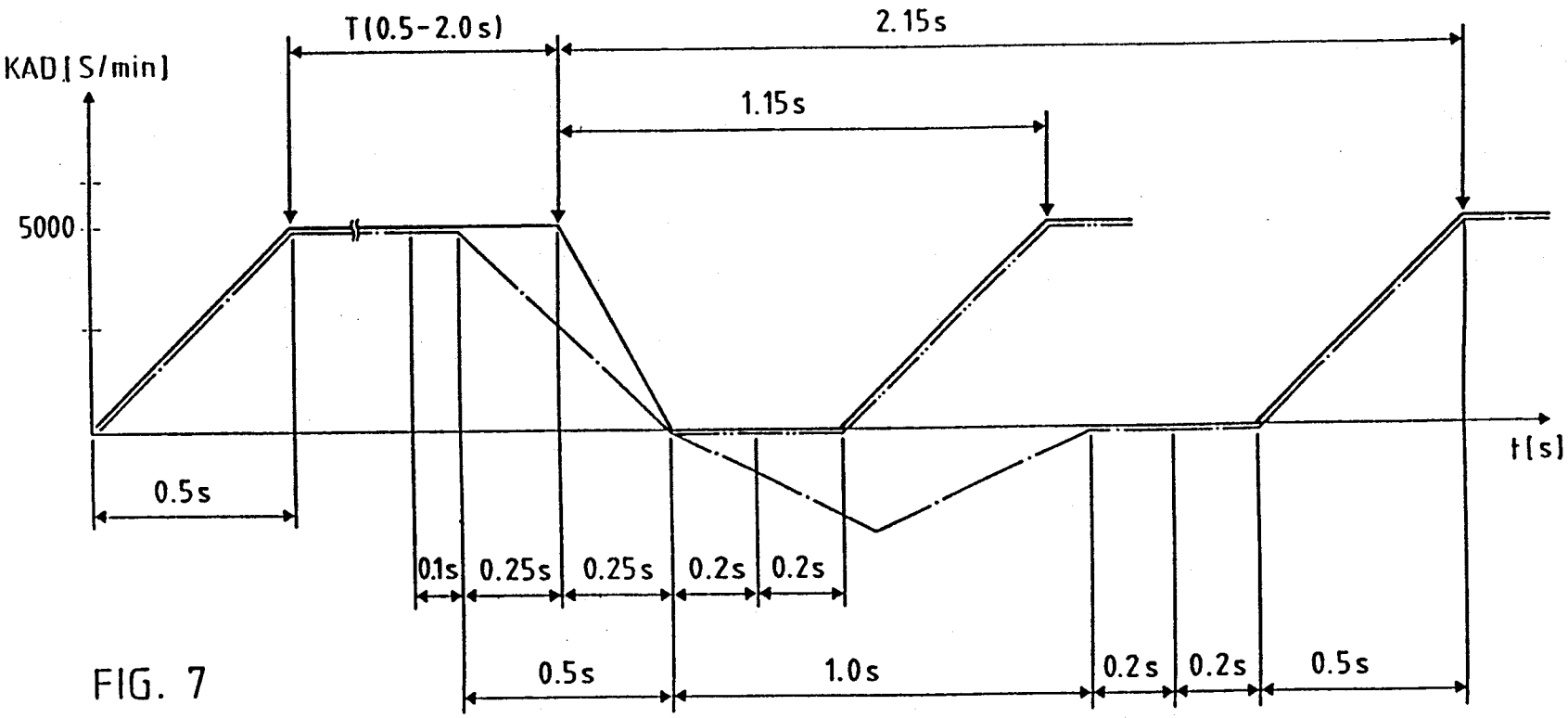
FIG. 7 is a diagram portraying the operation of the firing weapon during individual firing bursts, wherein the firing weapon operation is depicted in the curve shown in full or solid lines and the ammunition or cartridge feed operation is depicted in the curve shown in chain-dot lines.

From the diagram depicted by way of example in FIG. 7, following activation of the drive of the multi-barrel firing weapons 12 and 13, 0.5 seconds are required until there is attained the firing rate of 5000 firings or shots per minute (see the full or solid line curve), that is to say, until the array of weapon barrels 15 are rotated at a rotational speed corresponding to this firing rate or cadence and there is fired the first ammunition round. Depending upon the duration of the firing burst, after 0.5 to 2.0 seconds there has been fired the last ammunition round. The braking of the array of weapon barrels is accomplished in about one-half of the time needed for running up to speed of the multi-barrel firing weapons 12 and 13. However, the corresponding clutch 35 or 36 is already previously disengaged, and specifically for the following reasons:

At the time of activation of the weapon drive there is also engaged the clutch 35 or 36. However, since the first endless chain 24*a* or 25*a*, upon activating the related multi-barrel firing weapon 12 or 13, does not receive any cartridges 32, a certain amount of time is needed until the first or lead cartridge 32 has reached the corresponding multi-barrel firing weapon 12 or 13. The length of this first endless chain 24*a* or 25*a* is chosen such that at the time there is reached the required weapon firing rate the first or lead cartridge 32 has reached the associated multi-barrel firing weapon 12 or 13. The corresponding clutch 35 or 36 must be disengaged at the proper point in time before termination of the firing burst, so that the cartridges 32 remaining upon the first endless chain 24*a* or 25*a*, as the case may be, can be fired, without there being delivered cartridges 32 from the second or third endless chains 16*b*, 19*b* or 18*b*, 21*b* such that after completion of the firing burst the corresponding first endless chain 24*a* or 25*a* is again empty.

By further referring to FIG. 7, it will be recognized that with the second type of ammunition a first ammunition round can be fired already after 1.15 seconds. On the other hand, with the same type of ammunition only following an interruption of 2.15 seconds can there be fired a first ammunition round of the next firing burst. The reason for this is that after engaging the clutch 36 for the other type of ammunition and upon switching the gate 29 there are required 0.4 seconds until the corresponding multi-barrel firing weapon 12 or 13 is ready to commence firing. On the other hand, prior to engaging or activating the clutch 35 for the first type of ammunition there is first required 1 second until the cartridge infeeding apparatus of the corresponding endless chain is again operationally ready.

According to the showing of FIG. 8, the multi-barrel firing weapons 12 and 13 and the first endless chains 24*a* and 25*a*, respectively, are driven by a suitable associated drive motor 37. A gun gate or switch 38 enables interrupting the infeed of cartridges 32 to the corresponding multi-barrel firing weapon 12 or 13. When this gun gate 38 is switched-in or activated, then the cartridges 32 are delivered by the associated endless chain 24*a* or 25*a* to the related multi-barrel firing weapon 12 or 13, respectively. As soon as the gun gate 38 is switched-off or de-activated, for instance, in the presence of a so-called hang fire, then the cartridges 32 no longer are fed to the associated multi-barrel firing weapon 12 or 13, rather are transported back by the associated endless chain 24*a* or 25*a*. These first endless chains 24*a* and 25*a* are each guided over a respective pair of deflection wheels or sprockets 39 or the like and travel through the elastic or flexible channels 24 and 25, respectively. The second endless chains 16*b* and 19*b* extend from the first ammunition magazines 16 and 19, respectively, to the first endless chains 24*a* and 25*a*, respectively. The third endless chains 18*b* and 21*b* extend from the second ammunition magazines 18 and 21, respectively, to the first endless chains 24*a* and 25*a*, respectively. By means of the clutch 35 the respective first endless chains 24*a* and 25*a* and the respective second endless chains 16*b* and 19*b* can be coupled with one another. By means of the other clutch 36 the respective first endless chains 24*a* and 25*a* and the respective third endless chains 18*b* and 21*b* can be coupled with one another.

As long as each gate 28 is activated or switched-in, the cartridges 32 move from the respective second endless chains 16*b* and 19*b* to the first endless chains 24*a* and 25*a*, respectively. If the respective gate 28 is switched-over or thrown, then the cartridges 32 remain upon the respective second endless chains 16*b* and 19*b* and are re-cycled or conveyed back to the first ammunition magazines 16 and 19, respectively. The same observations are valid for each of the other gates 29. As long as each such gate 29 is switched-in, cartridges 32 are moved from the respective third endless chains 18*b* and 21*b* to the first endless chains 24*a* and 25*a*, respectively. If each gate 29 is switched-over or thrown, then the cartridges 32 remain upon the respective third endless chains 18*b* and 21*b* and are transported back to the second ammunition magazines 18 and 21, respectively. A respective endless chain 16*c*, 18*c*, 19*c* and 21*c* is located in each of the four ammunition magazines 16, 18, 19 and 21, respectively, these chains 16*c*, 18*c*, 19*c* and 21*c* being operatively connected with an associated drive motor 40 or 41, as the case may be, for the drive of these four endless chains 16*c*, 18*c*, 19*c* and 21*c*.

Having had the benefit of the foregoing description of the inventive cartridge infeed apparatus, there will be now considered the mode of operation of such apparatus for infeeding cartridges to a multi-barrel firing weapon from an associated stationary ammunition magazine or container, and which is as follows:

In order to release a series fire or firing burst, the not here shown trigger of the multi-barrel firing weapon 12 or 13, as the case may be, is activated. According to the illustration of FIG. 8, the drive motors 37, 40 and 41 of the multi-barrel firing weapons 12 and 13 and the ammunition magazines 16, 19 and 18, 21, respectively, are activated, depending upon which type of ammunition is desired to be fired. Depending upon the selected type of ammunition there is simultaneously engaged the one or the other of the clutches 35 or 36, and the three gates 28, 29 and 42, depicted in FIG. 6, must be properly positioned. During such time as the array or cluster of weapon barrels 15 of each multi-barrel firing weapon 12 and 13 is accelerated to the full rotational speed there is also initiated the infeed of the ammunition, and the first or lead cartridge 32 which is delivered to the corresponding multi-barrel firing weapon 12 or 13, should be located at the region of the associated sensor 50 or 51, depending upon the desired type of ammunition to be fired (see FIG. 6). These cartridges 32 arrive at the transfer wheels 26*a* and 26*b* or the transfer wheels 27*a* and 27*b*, as the case may be, and from that location are delivered to the endless chains 24*a* and 25*a*. As soon as the array of weapon barrels 15 of each of the multi-barrel firing weapons 12 and 13 has run up to speed and reached its full rotational speed, then also the first or lead cartridge 32 arrives at the relevant multi-barrel firing weapon 12 or 13. As seen from FIG. 7, after, for example, 0.5 seconds there is fired the first ammunition round.

As soon as the series fire or firing burst should be terminated, depending upon the type of ammunition, the relevant one of the gates 28 or 29 (FIG. 6) is activated, and shortly thereafter, the relevant one of the clutches 34 or 35, that is to say, the gate 28 or 29 is positioned such that no cartridges 32 are infed and the clutch 34 or 35, as the case may be, is de-activated or disengaged when the transfer wheel 26*a* or 27*a* no longer carries any cartridges 32. Until such time as the relevant multi-barrel firing weapon 12 or 13 comes to standstill, that is to say, until the weapon barrels 15 stop rotating, all of the cartridges 32 located upon the endless chain 24*a* or 25*a*, as the case may be, are fired. At the same time the relevant endless chains 16*b* or 19*b* and 18*b* or 21*b* are braked to standstill and subsequently rearwardly moved or reversed until the first or lead cartridge 32 again is located in the starting position at the associated sensor 50 or 51, as the case may be. From the showing of FIG. 7 it will be apparent that 0.5 seconds after turning-off the drive motor 40 or 41, as the case may be, the infeed of ammunition is stopped (see the chain-dot curve) and 0.25 seconds after turning-off the drive motor 37 the array of weapon barrels 15 stops rotating (see the full line curve). The infeed of the cartridges 32 arrives back in the starting position at the sensors 50 or 51, as the case may be, only after 1.0 second. The second ammunition magazine 18 and 21 is prepared for the next firing burst already after 0.4 seconds.

While there are shown and described present preferred embodiments of the invention, it is distinctly to be understood the invention is not limited thereto, but may be otherwise variously embodied and practiced within the scope of the following claims.

What is claimed is:

1. An apparatus for the controlled infeed of cartridges from a stationary ammunition magazine to a multi-barrel firing weapon having an array of rotatable weapon barrels, comprising:

gate means for switching-on and switching-off the infeed of the cartridges;

a first endless chain for the delivery of the cartridges from the gate means to the firing weapon;

a second endless chain with controllable cartridge return for the delivery of the cartridges from the stationary ammunition magazine to the gate means;

two transfer wheels arranged between the first endless chain and the second endless chain;

a clutch between said two transfer wheels, operatively interconnecting said first endless chain with said second endless chain;

a sensor for detecting the presence of a cartridge in a starting position, said cartridge to be delivered first to said first endless chain at the beginning of a firing burst;

a separate channel for the return of spent cartridge casings from the first endless chain; and the gate means being switched off and thereafter the clutch being de-activated for the termination of a firing burst.

2. An apparatus for the controlled infeed of cartridges from a stationary ammunition magazine to a multi-barrel firing weapon having an array of rotatable weapon barrels, comprising:

gate means for switching-on and switching-off the infeed of cartridges;

a first endless chain for the delivery of the cartridges from said gate means to the firing weapon;

a second endless chain with controllable cartridge return for the delivery of the cartridges from said stationary ammunition magazine to said gate means;

two transfer wheels arranged between said first endless chain and said second endless chain;

a clutch between the two transfer wheels, operatively interconnecting said first endless chain with said second endless chain;

a sensor for detecting the presence of a cartridge in a starting position, said cartridge to be delivered first to said first endless chain at the beginning of a firing burst;

a separate channel for the return of spent cartridge casings from said first endless chain;

said gate means being switched-off and thereafter said clutch being de-activated from the termination of said firing-burst;

a further stationary ammunition magazine;

a further gate means for switching-on and switching-off the infeed of cartridges;

a third endless chain with controllable cartridge return for the infeed of cartridges from the further ammunition magazine to the further gate means;

two further transfer wheels arranged between the first endless chain and the third endless chain;

a further clutch between the two further transfer wheels, for operatively interconnecting the first endless chain with the third endless chain;

a further sensor for detecting the presence of a further cartridge in a further starting position, said further cartridge to be delivered first to the first endless chain at the beginning of a further firing burst;

said further gate means being switched-off and thereafter said further clutch being de-activated for the termination of said further firing-burst; and a still further gate means arranged between the transfer wheels, the further transfer wheels and the first endless chain for the selective switching-in of either the ammunition magazine or the further ammunition magazine.

* * * * *